US007744377B2

(12) United States Patent
Wu et al.

(10) Patent No.: US 7,744,377 B2
(45) Date of Patent: Jun. 29, 2010

(54) ELECTRICAL CONNECTOR WITH LOW PROFILE CONTACTS

(75) Inventors: Chun-Kwan Wu, Tu-cheng (TW); Chih-Hsiang Ho, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/586,140

(22) Filed: Sep. 16, 2009

(65) Prior Publication Data

US 2010/0068900 A1 Mar. 18, 2010

(30) Foreign Application Priority Data

Sep. 16, 2008 (TW) ..... 97135422 A

(51) Int. Cl.
*H01R 12/00* (2006.01)

(52) U.S. Cl. ..... 439/74

(58) Field of Classification Search ..... 439/74, 439/346, 660, 495–497
See application file for complete search history.

(56) References Cited

U.S. PATENT DOCUMENTS 7,134,907 B2 * 11/2006 Watanabe et al. ..... 439/495
7,207,842 B1 * 4/2007 Kenjo ..... 439/607.01
7,278,861 B2 10/2007 Kishi et al.
7,377,803 B2 * 5/2008 Matsuoka ..... 439/497

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector includes: an insulating housing having a plurality of passageways; a plurality of contacts retained in the passageways of the insulating housing, the contact having a retaining beam engaged with the insulating housing, a first contacting beam extending from the retaining beam, a second contacting beam opposite to the first contacting beam and a connecting portion connected with the first and second contacting beam. The second contacting beam and the connecting portion define an acute angle between 10° to 40° to make the contact in a low profile. The insulating housing has a blocking portion with a large thickness protruding into the passageway to downwardly block the second contacting beam from upwardly moving.

7 Claims, 4 Drawing Sheets

ELECTRICAL CONNECTOR WITH LOW PROFILE CONTACTS

BACKGROUND OF THE INVENTION

1. Field of the Invention

The present invention relates to an electrical connector with low profile for connecting with two PCBs.

2. Description of Related Art

An electrical connector assembly is used for connecting with two PCBs. As disclosed in U.S. Pat. No. 7,278,861, an electrical connector assembly includes a receptacle and a plug mating with the receptacle. Said receptacle includes an insulating housing defining a receiving room and a plurality of contacts retained in the insulating housing. Said insulating housing has four peripheral sidewalls surrounding the receiving room and a tongue portion surrounded by said sidewalls and extending upwardly into the receiving room. The contact includes a first mating beam retained on an inner surface of the sidewall and a second mating beam retained on one side of the tongue portion opposite to said first mating beam. The tongue portion defines a plurality of passageways located under a top wall thereof for receiving said second mating beam. During the receptacle dismates with the plug vertically, the top wall of the tongue portion can prevent the second mating beam of the contact from being pulled out upwardly. When said receptacle is used in a low profile assembly with a lower size, the top wall should be formed much thinner in the vertical direction to meet the lower size, which weakens intensity of the top wall of the tongue portion. As a result, the top wall will be broken easily after many times of mating.

So it is necessary to provide a new electrical connector to solve the problems above.

SUMMARY OF THE INVENTION

Accordingly, it is an object of the present invention to provide an electrical connector which can retain contacts of low profile more securely.

In order to achieve above-mentioned object, an electrical connector is provided and comprises: an insulating housing having a plurality of passageways; a plurality of contacts retained in said passageways of the insulating housing, said contact having a retaining beam engaged with the insulating housing, a first contacting beam extending from said retaining beam, a second contacting beam opposite to said first contacting beam and a connecting portion connected with said first and second contacting beam. Said second contacting beam and said connecting portion define an acute angle between 10° to 40°, the insulating housing has a blocking portion protruding into the passageway to downwardly block the second contacting beam from upwardly moving.

Other objects, advantages and novel features of the present invention will become more apparent from the following detailed description of the present embodiment when taken in conjunction with the accompanying drawings.

DETAILED DESCRIPTION OF THE INVENTION

Figure 1:
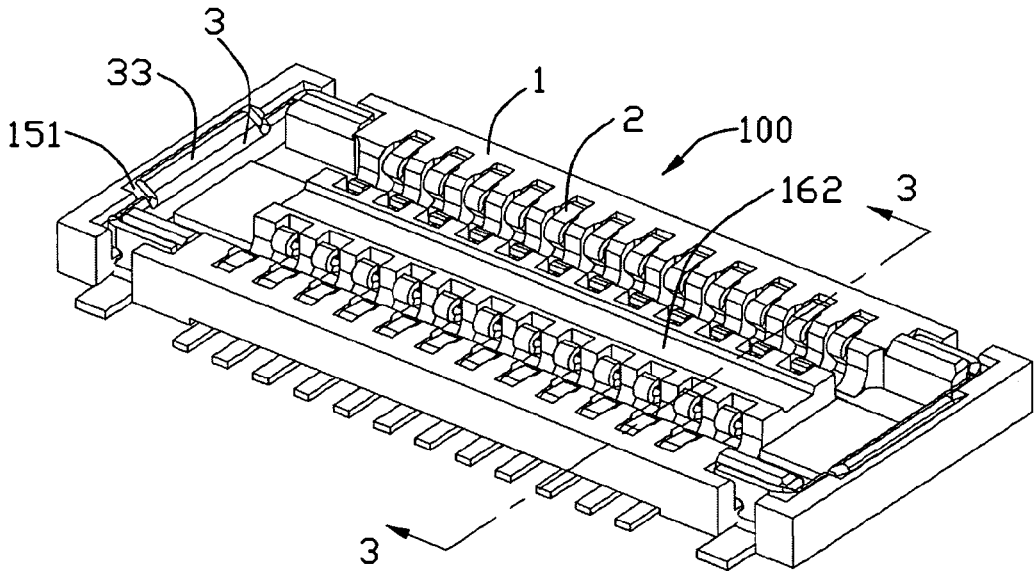
FIG. 1 is a perspective view of the electrical connector in accordance with the present invention.

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Referring to FIGS. 1 to 4, the electrical connector 100 used for mating with a mating connector 200 includes a longitudinal insulating housing 1, a plurality of contacts 2 retained in the insulating housing 1 and a pair of retention member 3.

Figure 2:
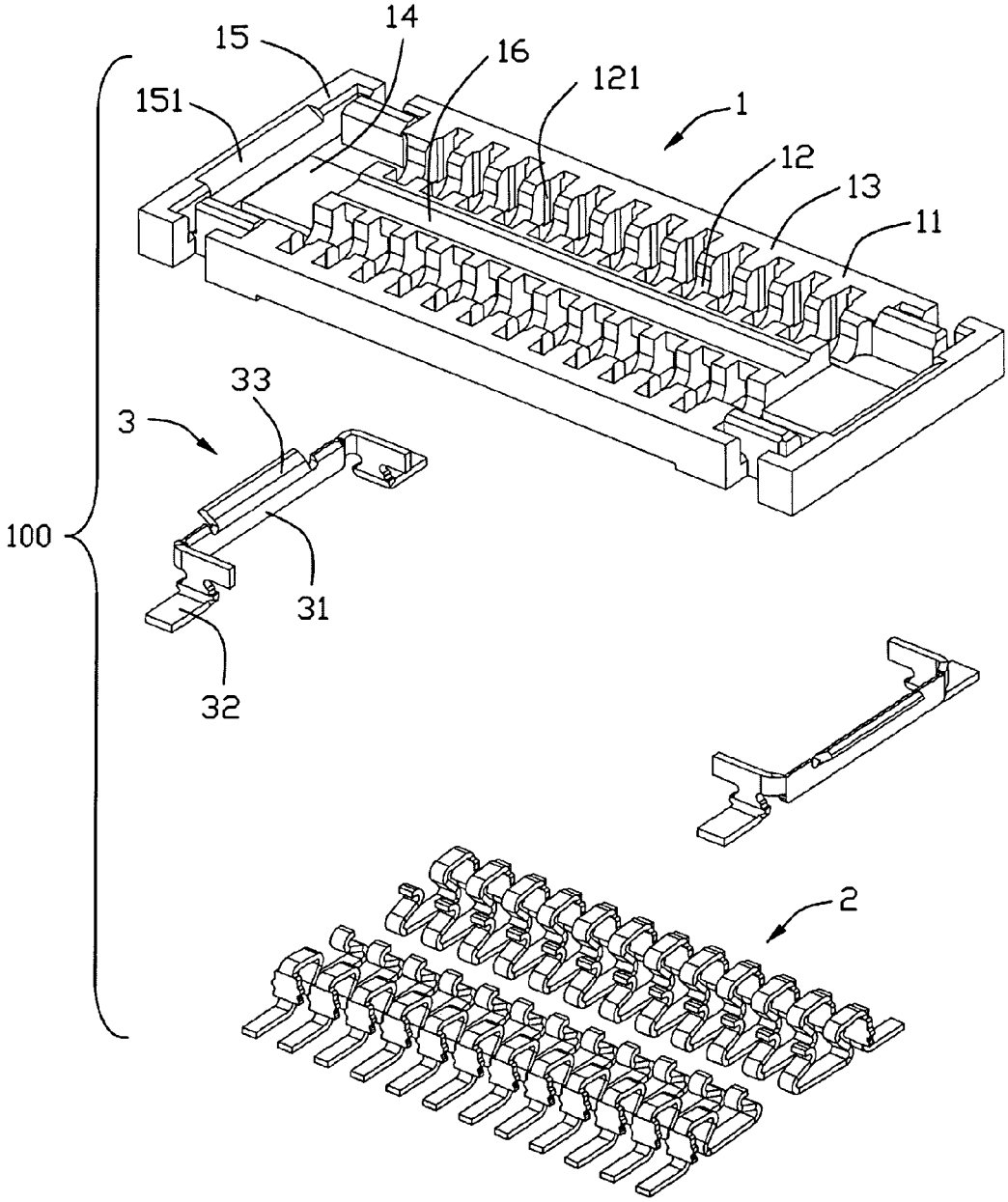
FIG. 2 is an exploded perspective view of the electrical connector of FIG. 1.
Figure 3:
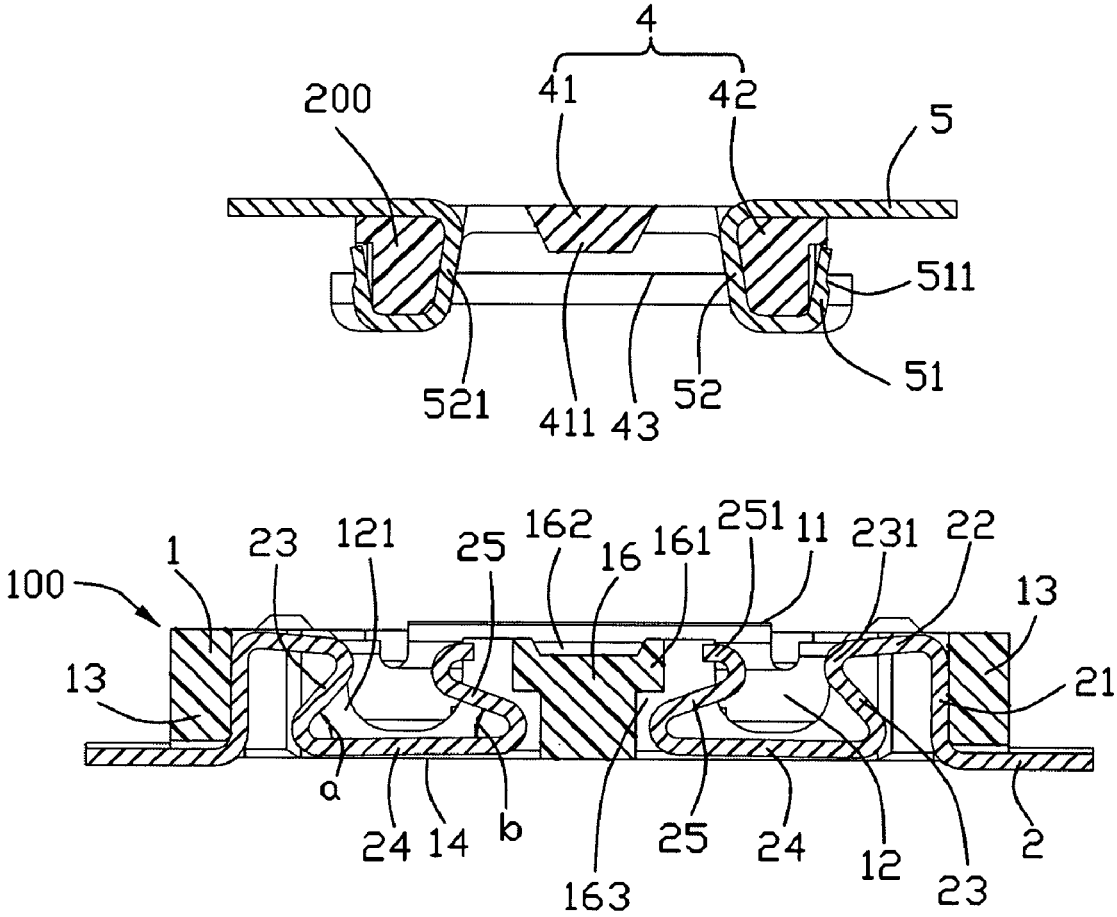
FIG. 3 is a cross-section schematic view of an un-mating state of the electrical connector and a mating connector of FIG. 1 along line 3-3.

In FIG. 2, the insulating housing 1 defines a mating surface 11 for mating with the mating connector 200 and a receiving room 12 depressed on the mating surface 11 for receiving said mating connector 200. The insulating housing 1 includes a pair of sidewalls 13, a pair of endwalls 15 connected with said sidewalls 13 for surrounding said receiving room 12, a bottom wall 14 and a longitudinal tongue portion 16 extending upwardly from the bottom wall 14 and peripherally surrounded by said sidewalls 13 and endwalls 15. The sidewall 13 defines a plurality of passageways 121 running through to the receiving room 12 on an inner surface thereof. Said passageway 121 extends inwardly through the bottom wall 14 and tongue portion 16 for receiving the contacts 2. The endwalls 15 are formed perpendicular to said sidewalls 13 and define a pair of depressed surface 151 facing the receiving room 12. The tongue portion 16 has a top wall which defines a plurality of blocking portions 161 (as shown in FIG. 3) formed in said passageways 121 respectively and a longitudinal slot 162 depressed on a top surface of said tongue portion 16. Said blocking portions 161 protrude into the passageways 121 and define concave rooms 163 located under the blocking portions 161 and running through the passageways 121.

As shown in FIGS. 2 and 3, the contact 20 includes a vertical retaining beam 21 retained in the sidewall 13, a first connecting beam 22 extending into the receiving room 12 horizontally from a top end of the retaining beam 21, a first contacting beam 23 downwardly extending from a tip end of said first connecting beam 22, a second connecting beam 24 extending horizontally toward the tongue portion 16 from a bottom end of said first contacting beam 23, and a second contacting beam 25 bended back toward said sidewall 13 from a tip end of the second connecting beam 24. The first contacting beam 23 extends slantways toward said retaining beam 21, which defines a protruding first mating portion 231 on a top end of the first contacting beam 23 projecting into the receiving room 12. Said second connecting beam 24 is horizontally retained in the bottom wall 14 and further makes an acute angle a with the slanted first contacting beam 23. The second contacting beam 25 extends slantways toward said first contacting beam 23 and makes an acute angle b with the second connecting beam 24. Said second contacting beam 25 is retained in the tongue portion 16 and has a lower arc portion located in the concave room 163 which is blocked by the blocking portion 161 upwardly. The second contacting beam 25 further includes a free tip end projecting into the receiving room 12 to define a second contacting portion 251 opposite to said first contacting portion 231. Said first contacting portions 231 and second contacting portions 251 are located on two lateral sides of the receiving room 12 for mating with the mating connector 200. In order to get a low profile, said acute angle a is formed between 30° to 60° while the acute angle b is formed between 10° to 40°, which not only reduces the height of the contact 2 but also provides an enough flexibility for the contacting beams 23, 25 during the mating process with the mating connector 200.

In FIG. 3, the mating connector 200 includes an insulating body 4 and a plurality of terminals 5 retained in the insulating body 4 for mating with the electrical connector 100 electrically. The insulating body 4 has a bottom wall 41 and four peripheral sidewalls 42 formed on a side edge of the bottom wall 41 to define a receiving groove 43 therebetween for engaging with said tongue portion 16. Said bottom wall 41 has a projecting rib 411 protruding into the receiving groove 43 upwardly to securely engage with the longitudinal slot 162 of the tongue portion 16 of the electrical connector 100. The terminal 5 includes a first mating portion 51 retained on an outer surface of the sidewall 42 for mating with the first contacting portion 231 and a second mating portion 52 retained on an inner surface of the sidewall 42 for mating with a second contacting portion 251. Said first mating portion 51 has a free tip end with a concave surface 511 for securely engaging with the first contacting portion 231. Said free tip end of the first mating portion 51 offsets from the sidewall 42 and defines a gap therebetween in order to get an enough flexibility. Said second mating portion 52 is slantly located on the sidewall 42 and has a slanted leading surface 521 facing to the receiving groove 43. The leading surface 521 extends inwardly closer to the projection rib 411, which makes an opening of the receiving groove 43 wider than a bottom of the receiving groove 43. As a result, the mating connector 200 can engage with the electrical connector 100 smoothly.

In FIG. 2, the retention member 3 are assembled on two longitudinal ends of the insulating housing 1 for being mounted on a PCB. Said retention member 3 includes a horizontal base portion 31, a pair of mounting portion 32 bended on two ends of the base portion 31 and a leading tab 33 upwardly protruding from said base portion 31 for engaging with the depressed surface 151 of the insulating housing 1. Said leading tab 33 can lead the mating connector 200 into the receiving room 12 of the insulating housing during the mating process which can prevent the insulating housing from being scraped.

Figure 4:
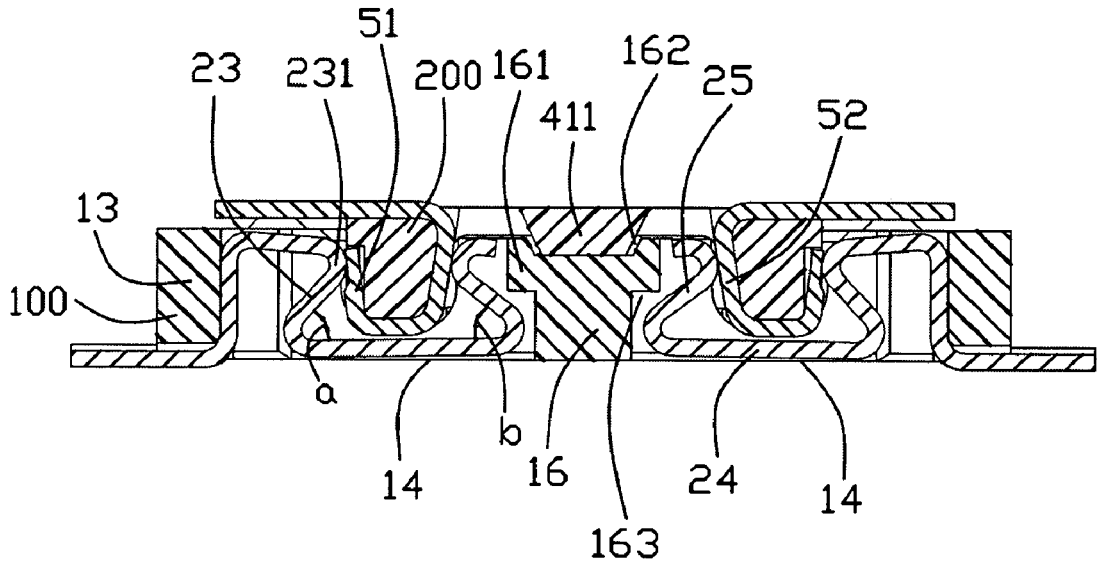
FIG. 4 is a cross-section schematic view of a mating state of the electrical connector and the mating connector.

After mating with the mating connector 200, as shown in FIG. 4, the contacts 2 of the electrical connector 100 can securely engage with the terminals 5 of the mating connector 200. The free tip end of the first mating portion 51 and the slanted leading surface 521 of the mating connector 200 respectively engage with the first mating portion 231 and the second contacting portion 251 of the electrical connector 100, which makes the mating process more smoothly. The concave surface 511 engages with the first mating portion 231 vertically so that the first and second contacting beam 23, 25 of the contact 2 can clamp the terminal 5 securely. Said acute angle b is formed between 10° to 40° so that the lower arc portion of the second contacting beam 25 can be located in the concave room 163 under the blocking portion 161 and the blocking portion 161 can extend downwardly with a large thickness. The blocking portion 161 can abut against said lower arc portion and prevent the second contacting beam 25 from being upwardly dragged by the terminal 5 during the process of dismating. As a result, the contacts 2 can be securely retained in the passageways 121 by the blocking portions 161 which are hard to crack. The acute angle a, b not only makes the contacts 2 formed in a low profile, but also makes the tongue portion 16 much stronger.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising: an insulating housing having a plurality of passageways; a plurality of contacts retained in said passageways of the insulating housing, said contact having a retaining beam engaged with the insulating housing, a first contacting beam extending from said retaining beam, a second contacting beam opposite to said first contacting beam and a connecting portion connected with said first and second contacting beam; wherein said second contacting beam and said connecting portion define an acute angle between 10° to 40° the insulating housing has a blocking portion protruding into the passageway to downwardly block the second contacting beam from upwardly moving, wherein said blocking portion defines a concave room located under the blocking portion and running through the passageways, wherein said first contacting beam and said connecting portion define an acute angle between 30° to 60°, wherein the second contacting beam has a lower arc portion connecting with said connecting portion, said lower arc portion further extends into the concave room and is upwardly blocked by the blocking portion.

2. The electrical connector as claimed in claim 1, wherein the insulating housing has four peripheral sidewalls and a tongue portion surrounded by said peripheral sidewalls, said blocking portion is formed on the tongue portion.

3. The electrical connector as claimed in claim 2, wherein said first contacting beam is retained in said peripheral sidewall while the second contacting beam is retained in the tongue portion.

4. The electrical connector as claimed in claim 3, wherein the first and second contacting beams respectively define a first contacting portion and a second contacting portion opposite to each other to clamp a mating connector therebetween.

5. The electrical connector as claimed in claim 4, wherein said passageway are formed on the peripheral sidewalls and further extending to the tongue portion, said blocking portions are located on two lateral sides of the tongue portion.

6. The electrical connector as claimed in claim 1, wherein the electrical connector further includes a pair of retention member with a pair of leading tabs formed thereon.

7. The electrical connector as claimed in claim 6, wherein said insulating housing defines a receiving room and a pair of depressed surfaces facing to the receiving room to engage with said leading tabs.

* * * * *